United States Patent [19]

DeFord et al.

[11] Patent Number: 4,603,794

[45] Date of Patent: Aug. 5, 1986

[54] PRESSURE MULTIPLYING DISPENSER

[75] Inventors: Henry S. DeFord; Owen R. Moss, both of Kennewick, Wash.

[73] Assignee: Battelle Development Corporation, Columbus, Ohio

[21] Appl. No.: 717,412

[22] Filed: Mar. 29, 1985

[51] Int. Cl.[4] ..... B65D 37/00

[52] U.S. Cl. ..... 222/207; 222/211; 222/249; 222/378; 222/409; 239/327; 239/369

[58] Field of Search ..... 222/206, 207, 209, 211, 222/215, 249, 335, 336, 372, 373, 378, 382, 395, 409, 464, 212, 213; 417/392, 489, 490; 239/327, 368, 369

[56] References Cited

U.S. PATENT DOCUMENTS

| | | | |
|---|---|---|---|
| 1,641,501 | 9/1927 | Post et al. | 417/490 |
| 2,080,864 | 5/1937 | Hilts | 222/211 |
| 2,796,294 | 6/1957 | McKinnon | 239/327 |
| 2,894,665 | 7/1959 | Zerlin | 222/378 |
| 3,176,883 | 4/1965 | Davis, Jr. | 222/211 X |
| 3,190,505 | 6/1965 | Arbitman et al. | 222/207 |
| 3,200,995 | 8/1965 | Gangwisch | 222/215 X |
| 3,221,945 | 12/1965 | Davis, Jr. | 222/211 |
| 3,323,689 | 6/1967 | Elmore | 222/209 X |
| 3,363,808 | 1/1968 | Gorman | 222/633 |
| 3,369,706 | 2/1968 | Schnyder | 222/335 X |
| 3,420,416 | 1/1969 | Brown | 222/335 |
| 4,087,023 | 5/1978 | Szczepanski | 222/211 X |
| 4,091,966 | 5/1978 | Laauwe | 222/211 |
| 4,398,396 | 8/1983 | Schmerzler | 417/392 X |
| 4,415,122 | 11/1983 | Laauwe | 239/327 |
| 4,557,401 | 12/1985 | Hodge | 222/211 |

*Primary Examiner*—Joseph J. Rolla
*Assistant Examiner*—P. McCoy Smith
*Attorney, Agent, or Firm*—Benjamin Mieliulis

[57] ABSTRACT

A pressure multiplying dispenser for delivering fluid, preferably as a spray to the atmosphere, from a source of fluid, preferably a spray bottle, is described. The dispenser includes in combination a hollow cylindrical member, a nozzle delivery tube within the cylindrical member and a hollow actuator piston slideable within the cylindrical member which acts to multiply the pressure of a squeeze applied to the spray bottle.

12 Claims, 6 Drawing Figures

PRESSURE MULTIPLYING DISPENSER

BACKGROUND OF THE INVENTION

1. Field of the Invention

This invention relates to dispensers of fluids and provides an alternative to pressurized aerosol containers now disfavored in light of increasing environmental concerns over various propellants such as flourocarbon propellents, and safety concerns over hydrocarbon propellants. A significant advance in the art of squeeze bottle technology is provided through a device capable of multiplying applied pressures by an order of magnitude.

2. Description of the Prior Art

A number of squeeze pumps and/or manually deformable squeeze bottles are known in the art. Patents such as Gorman U.S. Pat. No. 3,363,808 discloses a spray bottle having a metering device. Davis U.S. Pat. No. 3,176,883 discloses a fluid dispenser incorporating flow control valves to prevent back siphoning. Gangwisch U.S. Pat. No. 3,200,995 discloses a multicompartment dispensing package. Sczepanski U.S. Pat. No. 4,087,023 discloses a flexible bottle of multiple components. Laauwe U.S. Pat. No. 4,091,966 discloses a squeeze bottle intended to discharge powders whether the bottle is held upright or inverted. Elmore U.S. Pat. No. 3,323,689 discloses a dispensing bottle with a manually deformable or bellows type pump.

Both pressurized and nonpressurized dispensers are known in the art. None of the prior art of unpressurized dispensers particularly deformable dispensers includes means to achieve significant multiplication of the pressure applied to the deformable dispenser. A pressure multiplier dispenser in a squeeze bottle type of device would obviate the present need to rely on aerosol containers for convenience packaging for many cosmetic, personal hygiene and household products.

SUMMARY OF THE INVENTION

The present invention discloses a dispenser comprising a fluid or liquid receptacle preferably a manually deformable bottle such as a squeeze bottle and a novel dispensing cap actuator device that achieves a significant multiplication in the pressure of the spray discharge as compared to the pressure applied to the squeeze bottle.

The basic elements of the dispenser include a spray nozzle, a cylinder vent nozzle, a squeeze bottle, a nozzle delivery tube, an actuator cylinder, and a hollow actuator piston. A filter screen can be provided at the bottom of the cylinder. The cylinder also includes an air intake valve port. The nozzle tube contains a nozzle valve port and the actuator piston contains a piston intake port.

The dispenser apparatus for a liquid receptacle comprises in combination an actuator cylinder which is a hollow cylindrical member, a nozzle delivery tube which is hollow, said tube extending substantially within the cylindrical member, and a hollow actuator piston which is a pressure multiplying piston, the piston having an internal diameter greater than the outside diameter of the nozzle delivery tube. The piston has at least one piston intake port or intake orifice. The piston also has an outlet orifice substantially of the outside diameter of the tube such that the piston is able to slide onto the tube and within the hollow cylindrical member. The interior of the nozzle delivery tube is in communication with or comes into communication with the interior of the hollow pressure multiplying piston during travel of the piston.

DETAILED DESCRIPTION

The dispenser of the present invention produces a high energy spray from a low pressure "squeeze".

Figure 1A:
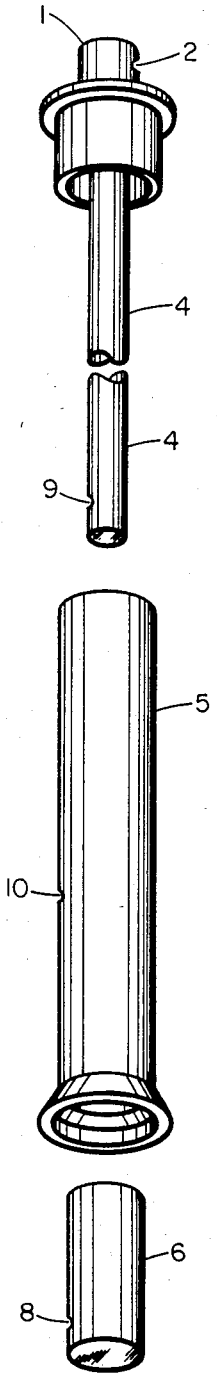
FIG. 1A is an exploded view of the pressure multiplying dispenser depicted in FIG. 1. (Optional screen 7 is not shown.)
Figure 1:
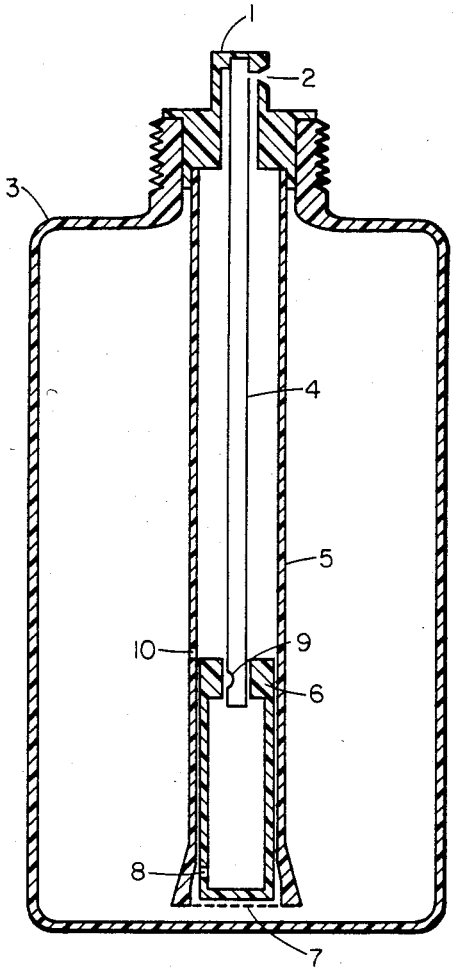
FIG. 1 is a receptacle and dispenser according to this invention.

FIG. 1 depicts a preferred embodiment of the dispenser and comprises a spray nozzle 1 with orifice 2 communicating with a cylinder vent and nozzle delivery tube. The dispenser further comprises nozzle delivery tube 4, actuator cylinder 5 (depicted here as having a flared open end for fluid inlet means), actuator piston 6, and preferably filter screen 7. Actuator piston 6 has piston intake port 8 or fluid inlet orifice. Actuator cylinder 5 has air intake valve port 10. Nozzle delivery tube 4 has a nozzle valve port 9 or fluid entrance means. The dispenser is shown in bottle 3 preferably a squeeze bottle.

A squeeze of bottle 3 urges bottle contents through piston intake port 8 into the chamber of hollow actuator piston 6. Actuator piston 6 begins an upward movement which seals off air intake valve port 10 of actuator cylinder 5 and seals off piston intake port 8 as it opens nozzle valve port 9 of nozzle delivery tube 4. The bottle contents and air in the chamber of actuator piston 6 are forced through nozzle valve port 9 and into nozzle delivery tube 4.

As actuator piston 6 continues travel up actuator cylinder 5, bottle contents now in nozzle delivery tube 4 continue travel out through orifice 2 of the spray nozzle. Upward movement of actuator piston 6 also forces air in the space of actuator cylinder 5 above actuator piston 6 out via the cylinder vent and through orifice 2. This air mixes with the bottle contents emerging also from orifice 2 further enhancing the fineness of the spray or mist. This direct venting through orifice 2 of the cylinder space above the actuator piston 6 is preferred but optional.

Releasing the squeeze bottle causes atmospheric pressure to return actuator piston 6 down actuator cylinder 5 thereby sealing nozzle valve port 9 and opening piston intake port 8. Air intake valve 10 opens allowing air to enter the bottle as it recovers.

The disclosed dispenser can eliminate the use of check valves to block back flow. Alternatively, nozzle valve port 9 conceivably could be positioned on the bottom of nozzle delivery tube 4 and a check valve thereat included or included anywhere along the flow path of the nozzle delivery tube.

Locating nozzle valve port 9 on the bottom rather than side of nozzle delivery tube 4 can cause the nozzle delivery tube to remain at all times in communication with the interior of actuator piston 6 except when the piston is at the very end of its stroke.

The fluid being dispensed provides the seals between the actuator cylinder and the actuator piston. Fluids of higher viscosity would enhance the efficiency of the device so long as they are not so viscous as to impair the movement of the actuator piston.

The dispenser is an apparatus for delivering fluid from a source of fluid when the fluid or fluid receptacle is subjected to a positive pressure, i.e. a squeeze. The dispenser apparatus comprises an actuator cylinder having an inlet means for inletting fluid. The actuator cylinder communicates with the source of fluid such as the contents of a squeeze bottle. The actuator cylinder has an outlet end comprising orifice means for delivering the bottle contents or fluids to the atmosphere.

The actuator piston is slideable within the actuator cylinder and can move from a first position near the inlet means of the actuator cylinder to a second position toward the outlet end. It will be clear that inlet means of the actuator cylinder can include an open end, preferably a flared end of the actuator cylinder which can be positioned close to the bottom of the fluid receptacle. Alternatively, it is evident the end of the actuator cylinder can be sealed and one or more inlet openings provided in the cylinder near the first position of the actuator piston at the approximate bottom of the piston.

The actuator piston is hollow and has at least one fluid inlet orifice, preferably on a side near the bottom of the piston. The fluid inlet orifice of the actuator piston communicates with the source of fluid when the actuator piston is in the first position or resting position but not when the actuator piston is in its second position since the wall of the actuator cylinder then serves to block the inlet orifice of the actuator piston.

The nozzle delivery tube is connected to the orifice means at the outlet end of the actuator cylinder. The nozzle delivery tube is preferably stationary. The delivery tube has an entrance end or other entrance means which communicates with the actuator piston. The entrance means of the delivery tube can be positioned on the end or a side near the end. The entrance means of the delivery tube communicates with the actuator piston for the purpose or function of delivering fluid from the actuator piston to the delivery tube.

Since various placements of the entrance means of the delivery tube are possible at an end or near an end, it would be the case that with any placement the delivery tube will be in communication with the fluid in the actuator piston at least when the actuator piston is between its first position and its second position. A few examples will illustrate this. When the entrance means is on a side near the end of the delivery tube, the wall of the piston can be used to block the entrance means when the piston is in its first position. Communication of the delivery tube with the piston interior would occur when the piston is between its first and second position, and when the piston is at its second position unless some raised shoulder, ring or wall were provided on the bottom of the piston interior to block the entrance means of the delivery tube when the actuator piston is at its second position.

Alternatively, if the entrance means is positioned on the end of the delivery tube, the tube would be in communication with the interior of the actuator piston when at its first position, when between its first and second position but not at its second position since the bottom of the actuator piston would block the delivery tube entrance means at the end of its travel unless a stop were provided to prevent full travel of the piston.

The actuator piston is used to both amplify the pressure of the applied squeeze and deliver fluid to the nozzle orifice for spray generation. In recovery, after delivering fluid upon a squeeze of the spray bottle, negative internal pressure (relative to ambient) can help refill actuator piston 6.

In principle when the piston is in the down position $P1$ (bottle)$=P2$ (piston) where P is pressure. When the actuator piston 6 moves up the actuator cylinder 5 sealing off piston intake port 8 and air intake port 10 as nozzle valve port 9 opens, liquid is confined to two areas—the bottle and the piston interior. At this point P1 can differ from P2.

Since $P=F/A$ where F is force and A is area, and in a system where $F1=F2$:

$$P2=P1\times(\text{piston radius})^2/(\text{nozzle tube radius})^2$$

Assuming a piston O.D. of 0.65 inches and a nozzle tube with an inside diameter of 0.2 inches, the calculated mechanical advantage M is:

$$M=(\text{piston radius})^2/(\text{nozzle tube inside radius})^2$$

$$M=0.33^2/0.1^2=10.9$$

Larger mechanical advantages are theoretically obtainable by, for example, reducing the cross-sectional area of the nozzle delivery tube 4.

The following is an illustration of the operating steps of the inventive actuator or dispenser device within a squeeze bottle.

There are three basic phases in the production of an amplified pressure spray discharge from a squeeze bottle incorporating the inventive actuator device. These three phases are: (1) beginning of the first squeeze, (2) continuation of the first squeeze and (3) end of the first squeeze.

At the beginning of the first squeeze the pressure in the nozzle delivery tube and the actuator cylinder is Pa. At the onset of the squeeze, the pressure in the bottle and below the actuator piston has increased to Pb. The actuator piston moves up slightly to seal the piston intake port and the air intake valve port.

During the continuation of the first squeeze, the pressure Pn in the nozzle delivery tube increases such that Pn>Pb>Pa. The pressure in the cylinder is still Pa. The actuator piston has moved up slightly to open the nozzle valve port. The pressure Pb in the bottle and below the actuator piston continues to increase.

At the end of the first squeeze, the pressure Pn in the nozzle tube has increased while the pressure in the cylinder is still essentially Pa. The actuator piston has moved to the end of its travel. The pressure in the bottle Pb and below the actuator piston has continued to increase but is less than Pn.

With $\text{Area}_p$ being approximately the cross-sectional area of the actuator piston and $\text{Area}_n$ the inside cross-sectional area of the nozzle tube, the multiplicative factor to first lift the actuator piston is the ratio of the cross-sectional outside area of the piston to cross-sectional inside area of the piston. This is the factor that causes the actuator piston to continue to rise in the cylinder. Once the nozzle valve port is opened, however, the pressure in the nozzle delivery tube is increased according to the multiplicative factor $Area_p$-:$Area_n$. With liquid confined in the piston interior Pb differs from Pn and $Pn=Pb$ $Area_p Area_n$. The force being applied to the base of the actuator piston is working against two forces Pa and Pn. Pa·$Area_p$+Pn-·$Area_n$+frictional drag equals the force applied to the base of the actuator piston. The maximum multiplicative factor for producing the spray is $Area_p/Area_n$.

Figure 2:
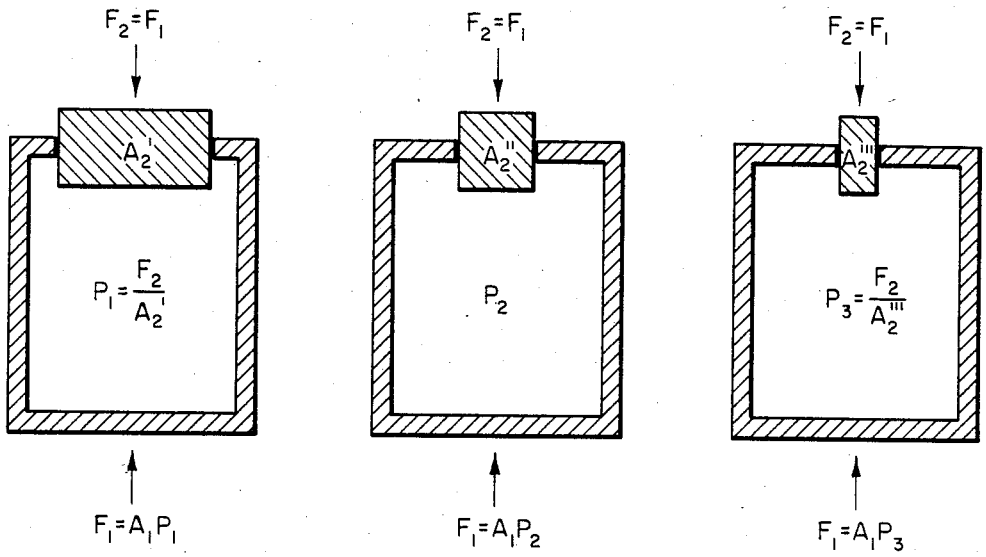
FIG. 2 is an illustration of the principle underlying the dispenser's pressure multiplication effect. Note that $P_3 > P_1$ given same applied force. (P stands for pressure.)

FIG. 2 illustrates the underlying principle of the dispenser's pressure multiplication effect. The pressures $P_1$, $P_2$, and $P_3$ inside the three illustrated fixed wall containers increase given the same applied forces $F_1$ and $F_2$ as the bottom facing area $A_2$ of the inserting ram respectively decreases. Pressure is calculated, pressure=force/area. Note that $P_3>P_1$ given same applied force.

Figure 3:
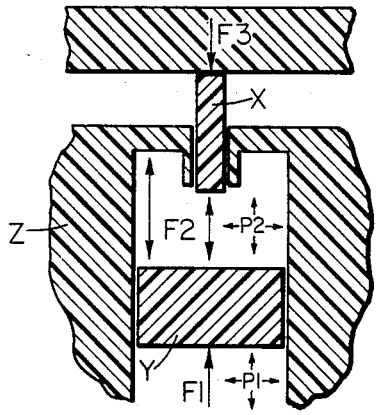
FIGS. 3 and 4 are additional illustrations of the pressure multiplying principle underlying the dispenser of the invention according to FIGS. 1 and 1A.
Figure 4:
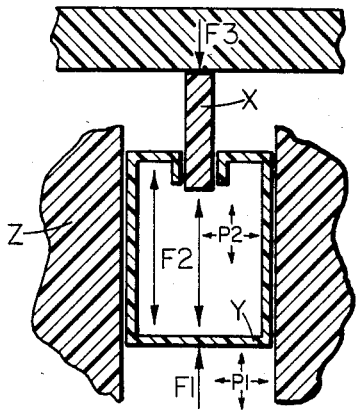

As an alternative explanation, attention is directed to FIG. 3 and FIG. 4.

Looking now at FIGS. 3 and 4 it would be error to assume that the dispenser of this invention is similar to the hydraulic device seen in most basic physics texts (FIG. 3). This is not exactly the case even if a leaky hydraulic ram is considered since, in the invention, block "Z" (FIG. 3) is allowed to freely move against atmospheric pressure and piston X.

The relation between pressure, force and area is $P=F/A$ . . . Pressure (*PSI*)=Force (Lbs)/Area (inches$^2$). p The force and pressure balance in the hydraulic ram (FIG. 3) is such that the hydraulic ram (FIG. 3) is at equilibrium when $P1=P2$. Piston Y will move until P1 is equal to P2.

In FIGS. 3 and 4, as an example let the radius of the larger piston be 0.375" (area=0.45 in$^2$), the radius of the smaller piston be 0.125" (area=0.05 in$^2$), and the pressure below the larger piston be 3 psi. Also assume that force F3 is exerted by an immobile object so that piston X cannot move.

$P=F/A$ is equivalent to $F=PA$ $F1$ (up on piston $Y$)=3 psi×0.45 in$^2$=1.35 lbs.

$F2$ (down on piston $Y$)=3 psi×0.45 in$^2$=1.35 lbs.

Note that force F2 comes from two sources:

1. $F3$ (up on piston $X$)=3 psi×0.05 in$^2$=0.15 lbs.
2. $F2$ (up on the cylinder top)=3 psi×(0.45−0.05 in$^2$)=1.2 lbs.

When the force UP is subtracted from the force DOWN the resulting net force is zero; the hydraulic ram is in equilibrium. The force F3 required to hold piston X immobile in this apparatus is 9 times less than the force F1 applied to piston Y. This principle is why a hydraulic jack can use the low pressure generated by a small piston to lift a large weight supported by a large piston.

The force and pressure balance in the dispenser device (FIG. 4) is as follows. FIG. 4 is essentially a simplified equivalent to the mechanism used in the dispenser device. Cylinder Z no longer has a top as it does for the hydraulic ram in FIG. 3. The top of the FIG. 4 apparatus is no longer part of the cylinder but is instead part of the larger piston.

In FIG. 4, P1 no longer needs to equal P2 in this system. In the FIG. 3 apparatus with piston X fixed, piston Y would move until pressures P1 and P2 were equal because only then would the net force on the system become zero. Piston Y will stop moving in the FIG. 4 apparatus also when the net force equals zero. But, pressure P2 must now be much greater than P1 before this equilibrium can occur.

In the previous example the radius of the larger piston was 0.375" (area=0.45 in$^2$), the radius of the smaller piston 0.125 (area=0.05 in$^2$), and the pressure below the larger piston was 3 psi.

$F=PA$ is equivalent to $P=F/A$ $F1$(up)=3 psi×0.45 in$^2$=1.35 lbs (this is the same as before)

For FIG. 3 we calculated the remaining forces with the knowledge that pressure P2 was also equal to 3 psi. In FIG. 4 we must calculate P2. Piston Y will stop moving only when F3 is equal to F1. (The force F2 no longer must be considered anywhere but at the base of piston X because the forces of F2 on the inside of piston Y cancel each other. Piston X is the only thing resisting the movement of piston Y.)

At equilibrium $F3=F1$=1.35 lbs.

$P2=F3$/(area piston $X$)=1.35 lbs/0.05 in$^2$=27 psi

The force balance for the bottle pump (FIG. 3) is:

$F2$ (down on piston $Y$)=27 psi×0.45 in$^2$=12.15 lbs $F2$ (up on piston $Y$)=27 psi×0.45−0.05 in$^2$=10.80 lbs. Remember that last time this force was applied to the immobile top of the cylinder. This time it is applied to piston Y.

$F2$ (UP on piston $X$)=27 psi×0.05 in$^2$=1.35 lbs $F3$ (down)=$F2$ (UP on piston $X$)=1.35 lbs.

In the invention thus we will have 3 psi below the piston, 27 psi within it, and the net force on the system will be zero. The sum of all forces is zero and pressure P2 is 9 times greater than P1.

The novel dispensing cap actuator device can be attached to a liquid receptacle by means such as threads or compression or other well known techniques. It is envisioned that the novel dispensing cap actuator device could be used with bottles other than squeeze bottles, though squeeze bottles are preferred. Other bottles could include rigid bottles with a means of applying a pressure to the bottle contents such as a deformable area, for example a bellows or a squeeze trigger that injects air to the bottle interior thus increasing the pressure and actuating the dispensing cap actuator device to begin its upward movement and achieve pressure multiplication inside the actuator piston.

It will also be apparent to those skilled in the art that not only liquids of various viscosities could comprise the bottle contents but also fluids that are fine powders especially fluids that are solutions of fine powders. The fluids functional in the device can include in addition to liquids, fluids such as fluid slurrys, for example, soaps or deodorants and other personal hygiene products, and can also include fluids such as gases with entrained liquids, gases with entrained solids and liquids with entrained solids. The inherent simplicity in the design as illustrated in FIG. 1 makes this device a commercially viable replacement for aerosol devices.

The cylinder and actuator piston and nozzle delivery tube, it will be apparent need not be cylindrical to be within the scope of the invention. Various geometrics variations are readily conceivable within the scope of the invention including for example making the cylinder cross-section instead of being a circle, one can fashion it as a hexagonal or even a star shaped cross-sectional cylinder. Of course the actuator piston would be fashioned of a corresponding and mating cross-sectional shape.

Other modifications of the basic concept of a cylinder, a nozzle delivery tube and hollow piston are readily apparent. If slippages between components are large enough, conceivably, though not preferred, the air intake valve port could be eliminated. The cylinder serves the basic function of being a guiding means by guiding the piston and blocking the piston intake port upon initiation of movement of the piston from its resting position. It would be apparent that portions of especially the lower section of the cylindrical member or guiding means can be opened or eliminated (since the entire circumference is not necessary for purposes of blocking the piston intake port) and the diameter of, for example, the lower half of the piston expanded within the squeeze bottle. Such modifications are clearly within the scope of the invention.

In designing and constructing prototypes it was found that the dispenser device would not function as well once the bottle fluid level dropped below the level of the actuator cylinder air intake valve port. Air escaping through the port prevents the cylinder from developing enough pressure differential to move the actuator piston. Reducing the size of the air intake port or blocking it entirely reduces this problem. Eliminating the air intake port increases the bottle recovery time following a squeeze; however, air infiltration due to slippage between components can render this time factor acceptable. An alternative design within the scope of this invention would comprise an air intake means such as a vent tube extending from the actuator cylinder air intake port to an area near the bottom of the bottle.

Figure 5:
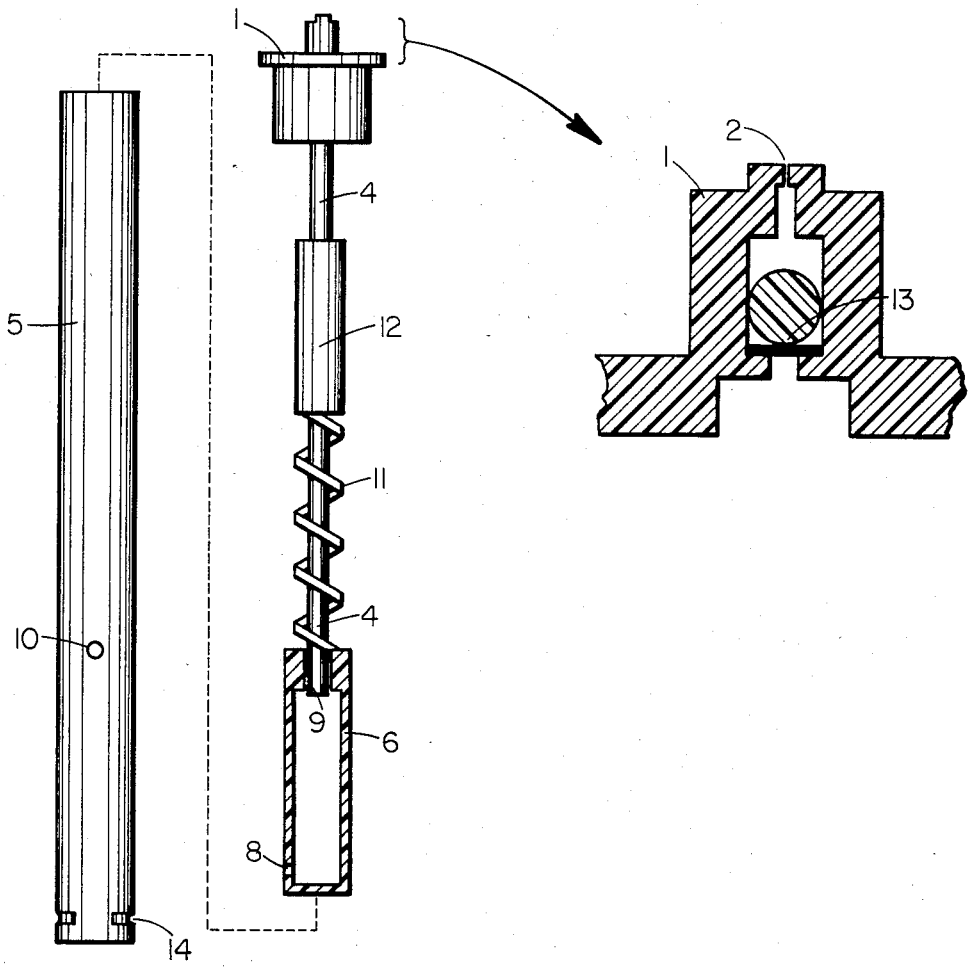
FIG. 5 is a depiction of one preferred embodiment prototype 1B including a piston return spring and check valve.

A preferred embodiment Prototype 1B included a piston return spring 11 positioned above the actuator piston and on the nozzle delivery tube. See. FIG. 5. A shoulder 12 was provided on the nozzle delivery tube to seat and retain the spring. Additionally the preferred embodiment included an optional ball and O-ring check valve 13 above the nozzle delivery tube 4 to prevent the piston from pulling air back into the nozzle delivery tube on its return stroke. FIG. 5 depicts actuator cylinder 5 having a sealed end with multiple fluid inlet means 14 near the end.

The inventive dispenser, it is evident can find applications not only in or with liquid receptacles that are spray bottles or other types of bottles that can be subjected to a positive pressure but also lends itself to unique and widely diverse applications such as a dispenser attached to a liquid receptacle which is for example a pipe or other conduit or tube. The dispenser, attached to an irrigation pipe with repetitively pulsed pressure could provide a method for delivery of a water spray to an agricultural crop. Since the dispenser multiplies pressure, less pressure in the pipe would be needed to effect a spray burst. Other examples readily evident to those skilled in the art become apparent.

EXAMPLE

TABLE 1

| | Applied Pressure via Squeeze | Pressure at Nozzle | Pressure Amplification |
|---|---|---|---|
| Prototype 1A | 1.75 psi | 8.5 psi | ×5 |
| Prototype 1B | 3 psi | 26 psi | ×8.6 |
| Prototype 1C | — | 23 psi | — |
| Spray Bottle | 3 psi | 3 psi | 0 |

Prototypes 1A, 1B and 1C were assembled according to FIGS. 1 and 1A. Prototype 1B included in addition the spring and check valve as shown in FIG. 5.

One of the prototypes was tested with liquids of viscosities relative to water ranging from 1 to 780. Liquids were formed by mixing glycerine with water at the ratios specified in Table D-230, CRC Handbook of Chemistry and Physics, 57th ed. The unit worked well with liquids of relative viscosity to approximately 60. Above relative viscosities of 400 the unit did not perform satisfactorily. The actual upper limit of operation appears to be between these viscosities.

Table 1 illustrates static pressure values obtained from prototypes of the invention. Pressure gauges were connected to the nozzle delivery tube and connected to an opening in the bottle wall communicating with the bottle interior. Check valves in the direction of the gauges were included. The bottle was pumped until maximum pressure at the nozzle delivery tube gauge was reached. It appears valid to assume that the maximum pressure showing on the nozzle delivery tube gauge would be no greater than the pressure generated by a single pump stroke.

The spray bottle tested for comparison purposes in Table 1 was a typical spray bottle having a central delivery tube not equipped with the dispenser device of the invention. Completely in keeping with Pascal's Law that pressures exerted by a confined liquid are uniform throughout an irregular shaped container, no pressure multiplication was detected with the typical spray bottle and 3 psi on the spray bottle interior yielded 3 psi at the nozzle. The inventive dispenser on the other hand yielded as high as 26 psi with 3 psi of applied pressure, or a multiplication of 8.6.

It will be understood by those skilled in the art that while the subject invention has been described with respect to the preferred embodiments, other changes in shape and size of the elements of the invention are readily apparent all without departing from the spirit and scope of the invention and the appended claims:

We claim:

1. A dispensing apparatus for delivering fluid from a source of fluid when subjected to a positive pressure comprising:

(a) an actuator cylinder having inlet means for inletting fluid communicating with the source of fluid and an outlet end connectable to orfice means for delivering the fluid to the atmosphere, (b) an actuator piston slideable onto a fixed position delivery tube and the actuator piston being slideable within the actuator cylinder from a first position near the inlet means to a second position toward the outlet end, the piston being hollow and having at least one fluid inlet orifice communicating with the actuator cylinder inlet means when the actuator piston is in the first position but not when the actuator piston is in the second position, and (c) the fixed position delivery tube having an exit end for delivering the fluid from the actuator piston to the orifice means connected to the outlet end of the actuator cylinder and having an entrance means communicating with the actuator piston for delivering fluid from the actuator piston to the delivery tube such that the interior of the delivery tube is in communication with the fluid in the actuator piston when the actuator piston is in its second position but not when the actuator piston is in its first position.

2. The apparatus according to claim 1 comprising in addition a spring acting on the actuator piston to assist return travel of the actuator piston from its second position to its first position.

3. The apparatus according to claim 1 wherein the delivery tube in addition includes a check valve to restrict back-flow of the fluid delivered to the orifice means connected to the outlet end of the actuator cylinder.

4. The apparatus according to claim 1 wherein the source of fluid is a deformable receptacle.

5. The apparatus according to claim 1 wherein the orifice means connected to the outlet end of the actuator cylinder communicates with both the delivery tube and the space of the actuator cylinder above the actuator piston such that a mixture of fluid and air is delivered to the orifice means when the actuator piston slides from its first position to its second position.

6. The apparatus according to claim 5 wherein the actuator cylinder includes in addition an air intake means for allowing air in the space of the actuator cylinder above the actuator piston to enter the fluid source when the actuator piston is in its first position.

7. A dispensing apparatus for delivering fluid from a source of fluid when subjected to a positive pressure comprising:

(a) an actuator cylinder having an inlet means for inletting fluid communicating with the source of fluid and an outlet end connectable to orifice means for delivering the fluid to the atmosphere, (b) an actuator piston slideable onto a fixed position delivery tube and the actuator piston being slideable within the actuator cylinder from a first position near the inlet means to a second position toward the outlet end, the piston being hollow and having at least one fluid inlet orifice communicating with the actuator cylinder inlet means when the actuator piston is in the first position but not when the actuator piston is in the second position, and (c) the fixed position delivery tube having an exit end for delivering the fluid from the actuator piston to the orifice means connected to the outlet end of the actuator cylinder and having an entrance means communicating with the actuator piston for delivering fluid from the actuator piston to the delivery tube such that the interior of the delivery tube is in communication with the interior of the actuator piston at least when the actuator piston is between its first position and its second position.

8. The apparatus according to claim 7 comprising in addition a spring acting on the actuator piston to assist return travel of the actuator piston from its second position to its first position.

9. The apparatus according to claim 7 wherein the delivery tube in addition includes a check valve to restrict back-flow of the fluid delivered to the orifice means connected to the outlet end of the actuator cylinder.

10. The apparatus according to claim 7 wherein the source of fluid is a deformable receptacle.

11. The apparatus according to claim 7 wherein the orifice means connected to the outlet end of the actuator cylinder communicates with both the delivery tube and the space of the actuator cylinder above the actuator piston such that a mixture of fluid and air is delivered to the orifice means when the actuator piston slides from its first position to its second position.

12. The apparatus according to claim 11 wherein the actuator cylinder includes in addition an air intake means for allowing air in the space of the actuator cylinder above the actuator piston to enter the fluid source when the actuator piston is in its first position.

* * * * *